US006583554B2

(12) United States Patent
Lee

(10) Patent No.: US 6,583,554 B2
(45) Date of Patent: Jun. 24, 2003

(54) FLAT LUMINESCENT LAMP AND METHOD FOR MANUFACTURING THE SAME

(75) Inventor: Jae Man Lee, Daejon-shi (KR)

(73) Assignees: LG. Philips LCD Co., Ltd., Seoul (KR); Sang Nong Enterprise Co., Ltd., Seoul (KR); Young Jong Lee, Daejon-Shi (KR)

( * ) Notice: Subject to any disclaimer, the term of this patent is extended or adjusted under 35 U.S.C. 154(b) by 121 days.

(21) Appl. No.: 09/894,836

(22) Filed: Jun. 29, 2001

(65) Prior Publication Data

US 2002/0105260 A1 Aug. 8, 2002

(30) Foreign Application Priority Data

Dec. 27, 2000 (KR) ..... 2000-83096

(51) Int. Cl.[7] ..... H01J 1/62; H01J 63/04

(52) U.S. Cl. ..... 313/495; 313/493; 313/634; 313/495; 313/631; 313/485; 313/483; 313/491; 313/492; 359/15; 359/742

(58) Field of Search ..... 313/484, 485, 313/487, 491, 492, 493, 631, 634; 359/15, 742

(56) References Cited

U.S. PATENT DOCUMENTS 4,155,024 A * 5/1979 Sonoda ..... 313/445
4,990,826 A * 2/1991 Cocks et al. ..... 313/485
5,276,378 A * 1/1994 Gothard ..... 313/491
5,329,203 A * 7/1994 Jeong ..... 313/491
5,343,115 A * 8/1994 Anandan et al. ..... 313/491
5,726,524 A * 3/1998 Debe ..... 313/309
5,936,347 A * 8/1999 Isaka et al. ..... 313/509
5,962,958 A * 10/1999 Nakamoto ..... 313/309
6,031,328 A * 2/2000 Nakamoto ..... 313/495
6,034,470 A 3/2000 Vollkommer et al.
6,140,759 A * 10/2000 Sreeram et al. ..... 313/493
6,215,246 B1 * 4/2001 Kim et al. ..... 313/584
6,426,590 B1 * 7/2002 Chung et al. ..... 313/496
6,469,451 B2 * 10/2002 Mori ..... 315/169.4

* cited by examiner

*Primary Examiner*—Nimeshkumar D. Patel
*Assistant Examiner*—Holly Harper
(74) *Attorney, Agent, or Firm*—Morgan, Lewis & Bockius LLP

(57) ABSTRACT

A flat luminescent lamp and a method for manufacturing the same are disclosed, in which light weight and high luminance can be obtained and discharge efficiency can be maximized. The flat luminescent lamp includes first and second substrates each having a plurality of concave and convex portions on an opposing surface, first and second electrodes alternately formed in the convex portions on the first substrate at constant intervals, a dielectric layer formed on the first substrate including the first and second electrodes, and first and second phosphor layers respectively formed on the dielectric layer and the second substrate. The method for manufacturing a flat luminescent lamp having first and second substrates includes etching the second substrate to form a plurality of concave and convex portions on one side, forming first and second electrodes alternately on the first substrate at constant intervals, etching the first substrate at both sides of the first and second electrodes at a predetermined depth to form a plurality of concave portions in the first substrate, forming a dielectric layer formed on the first substrate including the first and second electrodes, forming first and second phosphor layers respectively on the dielectric layer and the second substrate, and attaching the first and second substrates to each other so that the concave portions of the first substrate correspond to the concave portions of the second substrate.

6 Claims, 8 Drawing Sheets

FLAT LUMINESCENT LAMP AND METHOD FOR MANUFACTURING THE SAME

The present invention claims the benefit of Korean Patent Application No. P2000-83096 filed in Korea on Dec. 27, 2000, which is hereby incorporated by reference.

BACKGROUND OF THE INVENTION

1. Field of the Invention

The present invention relates to a light source for a display device, and more particularly, to a flat luminescent lamp and a method for manufacturing the same.

2. Discussion of the Related Art

Ultra thin sized flat panel displays having a display screen with a thickness of several millimeters or less, and in particular, flat panel liquid crystal display (LCD) devices, are widely used as monitors in notebook computers, spacecraft, and aircraft.

In such LCD devices, a passive luminescence LCD device includes a back light positioned at the rear of a liquid crystal panel. The back light increases the weight, power consumption, and thickness of a flat panel LCD device.

The back light used in LCD devices as a light source is generally an arrangement of a cylindrical fluorescent lamp. There are two types of back lights, a direct type and a light-guiding plate type.

In the direct type back light, the fluorescent lamp is mounted under the flat panel LCD. If the fluorescent lamp is too close to the LCD flat panel, the shape of the fluorescent lamp is visible on the LCD screen. Therefore, it is necessary to maintain a distance and position between the fluorescent lamp and the liquid crystal panel. As a result, there is a limitation in reducing the thickness of an LCD device that uses a direct type back light.

Furthermore, a light-scattering means may have to be positioned between the fluorescent lamp and the liquid crystal panel for uniform light distribution. Due to the trend of increased display panel area, the light-emitting area of the back light is also increasing. If the direct type back light has a large sized area, the light-scattering means should have a sufficient thickness to make the light-emitting area have a uniform luminescent intensity. Therefore, the need for uniform light-scattering also limits the thickness reduction of the LCD device using direct type back light.

In the light-guiding plate type back light, a fluorescent lamp is mounted outside the LCD flat panel so that light is dispersed across the back surface of the LCD flat panel using a light-guiding plate. Since the fluorescent lamp is mounted at a side of the light-guiding plate, light passing through a side of the light-guiding plate has to be dispersed across the entire surface of the LCD flat panel. Therefore, luminance is low. Also, for uniform distribution of luminous intensity, advanced optical design and processing technologies are required to manufacture the light-guiding plate.

A high luminance direct type back light has been proposed in which a plurality of lamps are arranged below a display surface or a lamp is bent into a circular shape. Recently, a flat luminescent back light in which a flat surface facing a display surface of a panel is wholly luminescent is being researched and developed. This flat luminescent back light is disclosed in the U.S. Pat. No. 6,034,470.

A related art flat luminescent lamp will be described with reference to the accompanying drawings.

FIG. 1 is a plan view illustrating a related art flat luminescent lamp, and FIG. 2 is a sectional view taken along line I–I' of FIG. 1.

As shown in FIGS. 1 and 2, the related art flat luminescent lamp includes a lower substrate 11, an upper substrate 11*a*, cathodes 10 formed on the lower substrate 11, anodes 10*a* formed on the upper substrate 11*a*, four frames 19*a*, 19*b*, 19*c*, and 19*d* for sealing a discharge space between the lower and upper substrates 11*a* and 11 by a solder means, such as a glass solder, and a plurality of support rods 21 formed between the lower and upper substrates 11 and 11*a*. The support rods 21 are made of glass material so as not to interrupt emission of the visible light.

The anodes 10*a* are formed in sets of pairs between support rods at constant intervals. The cathodes 10 are formed on the lower substrate 11 between the sets of pairs anodes 10*a*. The cathodes 10 and the anodes 10*a* are coated with a dielectric material (not shown), and an external voltage is applied to the cathodes 10 and the anodes 10*a* through lead lines 13 and 13*a*, respectively.

Surfaces of the upper substrate 11*a* and lower substrate 11 facing the discharge space are coated with a fluorescent material (not shown). Within the discharge space is a Xe gas for creating plasma that emits ultraviolet (UV) rays. The emitted UV rays collide with the fluorescent material formed on the upper and lower substrates 11*a* and 11. The collision of the UV rays with the fluorescent material generates visible light.

As shown in FIG. 2, the cathodes 10 are formed on the lower substrate 11 of glass material, and a first dielectric material layer 12 is formed on the lower substrate 11 and the cathodes 10. A reflecting plate 14 is formed on the first dielectric material layer 12 and a first phosphor layer 15 is formed on the reflecting plate 14. The reflecting plate 14 serves to prevent the visible light from leaking out the rear of the lower substrate 11. The anodes 10*a* that induces the plasma discharge together with the cathodes 10 are formed on the upper substrate 11*a* of glass material. The cathodes 10 and the anodes 10*a* are formed by silk printing or vapor deposition process.

A second dielectric material layer 12*a* is formed on the upper substrate 11*a* and the anodes 10*a*. A second phosphor layer 15*a* is formed on the second dielectric material layer 12*a*. On the upper and lower substrates 11*a* and 11, frames 19*a*, 19*b*, 19*c*, and 19*d* are formed to seal the upper and lower substrates 11*a* and 11 by a glass solder.

In the aforementioned related art flat luminescent lamp, if a voltage is applied to the cathodes 10 and the anodes 10*a* through the respective lead lines 13 and 13*a*, Xe gas forms plasma in the discharge space between the cathodes 10 and the anodes 10*a* and emits UV rays. The UV rays collide with the first and second phosphor layers 15 and 15*a*, causing the phosphor layers to luminesce, so that the visible light is emitted.

However, the related art flat luminescent lamp has several problems. Since four frames and a number of support rods are required to seal the lower and upper substrates, a large number of parts for manufacturing the lamp are required and thus, processing steps are complicated. Furthermore, the large number of parts increases the weight and size of the lamp.

SUMMARY OF THE INVENTION

Accordingly, the present invention is directed to a flat luminescent lamp and a method for manufacturing the same that substantially obviates one or more of the problems due to limitations and disadvantages of the related art.

An object of the present invention is to provide a flat luminescent lamp and a method for manufacturing the same, in which light weight, thin size and high luminance can be obtained.

Another object of the present invention is to provide a flat luminescent lamp and a method for manufacturing the same, in which discharge efficiency can be maximized.

Additional features and advantages of the invention will be set forth in the description which follows, and in part will be apparent from the description, or may be learned by practice of the invention. The objectives and other advantages of the invention will be realized and attained by the scheme particularly pointed out in the written description and claims hereof as well as the appended drawings.

To achieve these and other advantages and in accordance with the purpose of the present invention, as embodied and broadly described, a flat luminescent lamp according to the present invention includes first and second substrates, each having a plurality of concave and convex portions on a surface; first and second electrodes alternately formed on the convex portions of the first substrate at constant intervals; a dielectric layer formed on the first substrate, and on the first and second electrodes; first and second phosphor layers respectively formed on the dielectric layer and the second substrate; and wherein the first and second substrates are attached to each other with their surfaces having the plurality of concave and convex portions facing each other.

In another aspect of the present invention, a method for manufacturing a flat luminescent lamp having first and second substrates, the method including the steps of etching the second substrate to form a plurality of concave and convex portions on one side of the second substrate; forming first and second electrodes alternately on the first substrate at constant intervals; etching the first substrate between the first and second electrodes to a predetermined depth in order to form a plurality of concave portions in the first substrate; forming a dielectric layer on the first substrate, and on the first and second electrodes; forming first and second phosphor layers respectively on the dielectric layer and the second substrate; and attaching the first and second substrates to each other so that the concave portions of the first substrate substantially correspond to the concave portions of the second substrate.

In other aspect of the present invention, a method for manufacturing a flat luminescent lamp includes the steps of forming first and second substrates, each respectively having a plurality of concave and convex portions on one side; forming first and second electrodes alternately formed on the convex portions of the first substrate; forming a dielectric layer on the first substrate, and on the first and second electrodes; forming first and second phosphor layers respectively on the dielectric layer and the second substrate; and attaching the first and second substrates to each other so that the concave and convex portions of the first substrate respectively correspond to the concave and convex portions of the second substrate.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which re included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
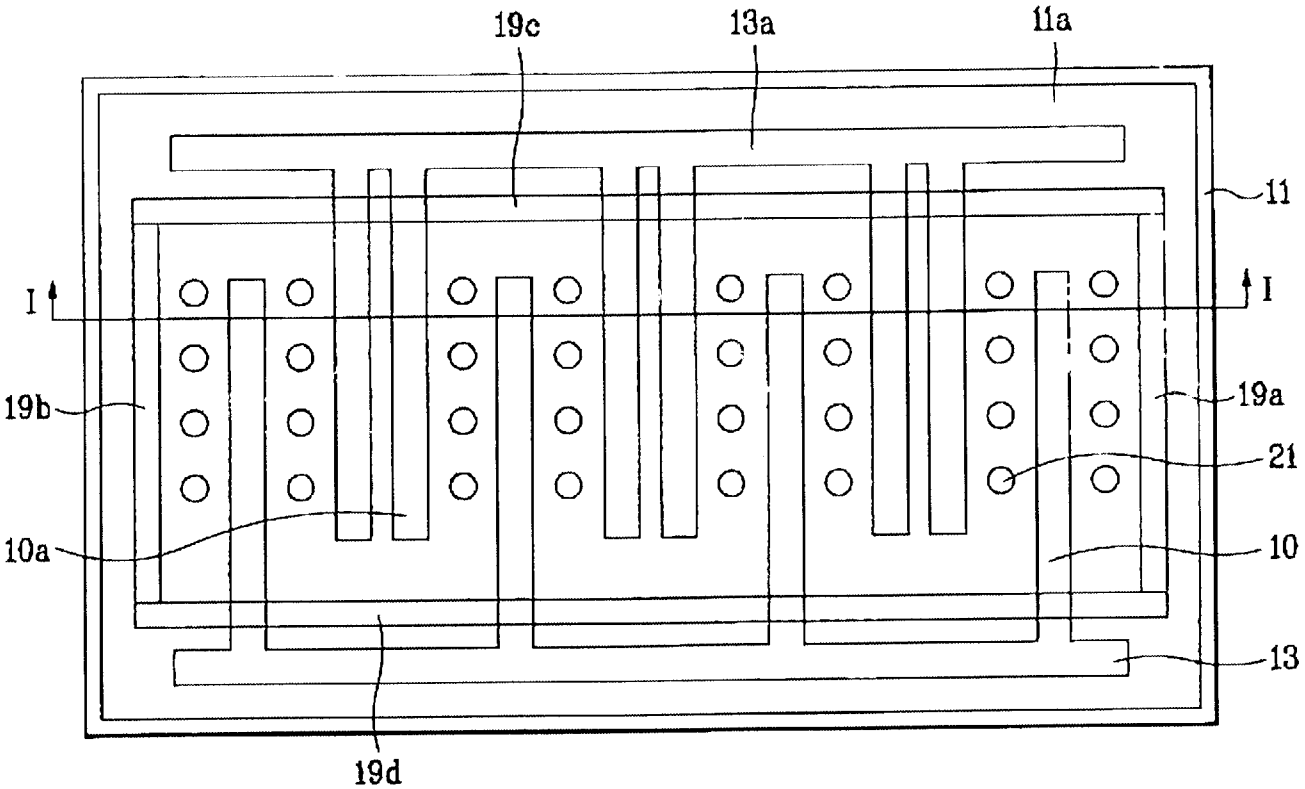
FIG.1 Related Art
FIG. 1 is a plan view illustrating a related art flat luminescent lamp.
Figure 2:
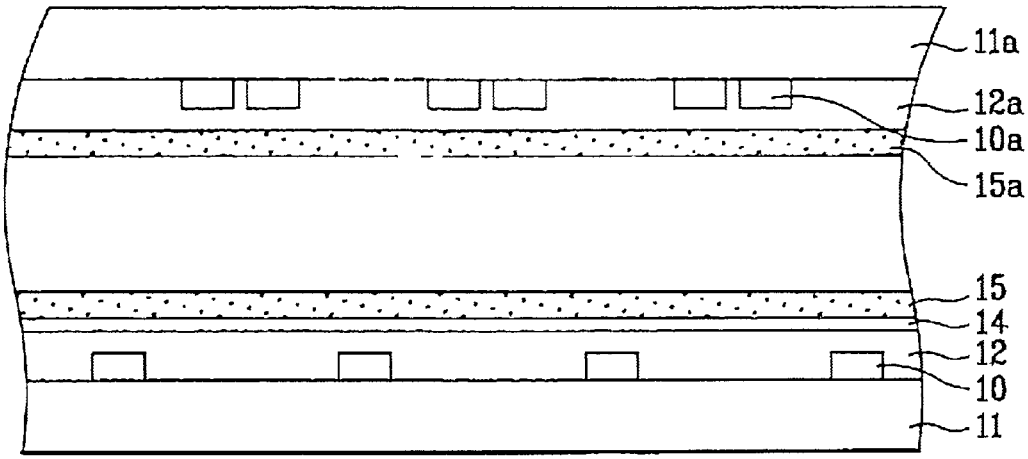
FIG.2 Related Art
FIG. 2 is a sectional view taken along line I–I' of FIG. 1.
Figure 3:
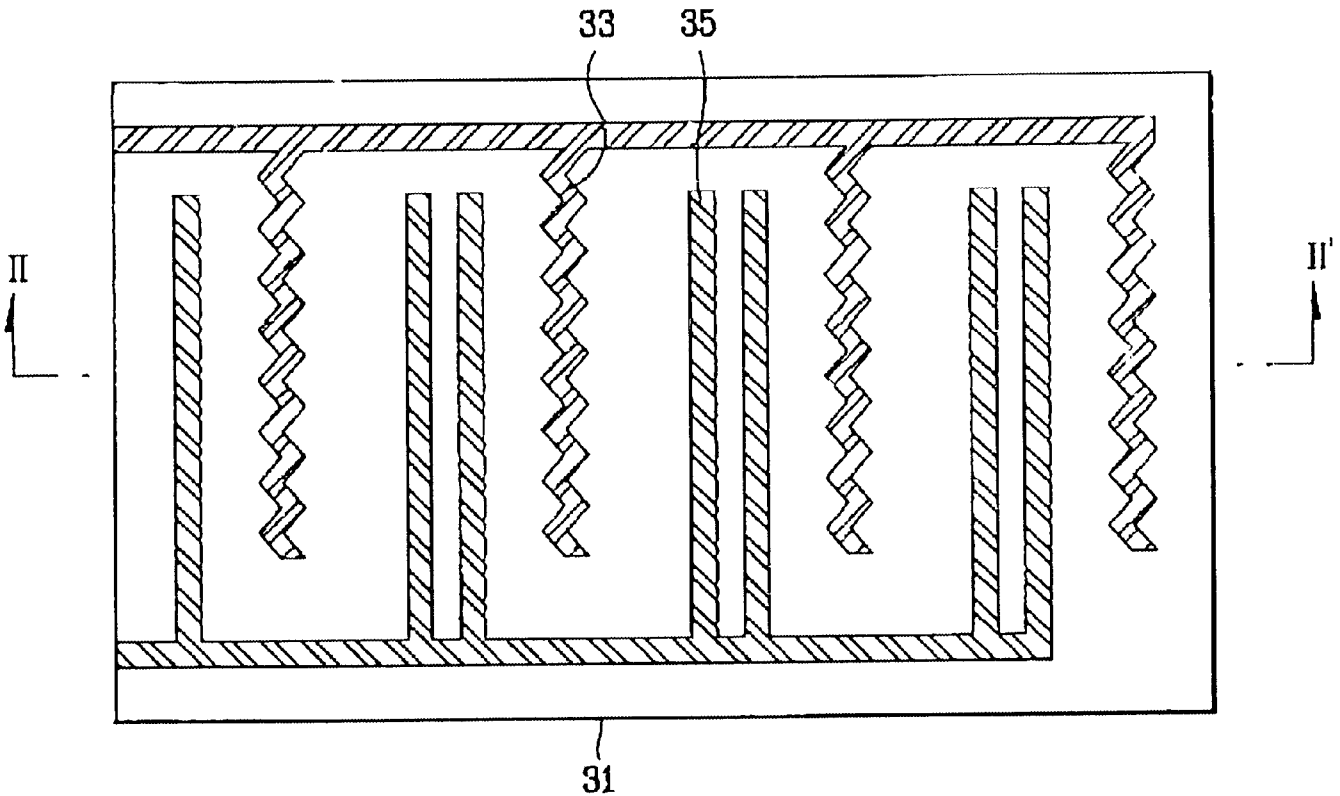
FIG. 3 is a plan view illustrating a flat luminescent lamp according to the present invention.
Figure 4:
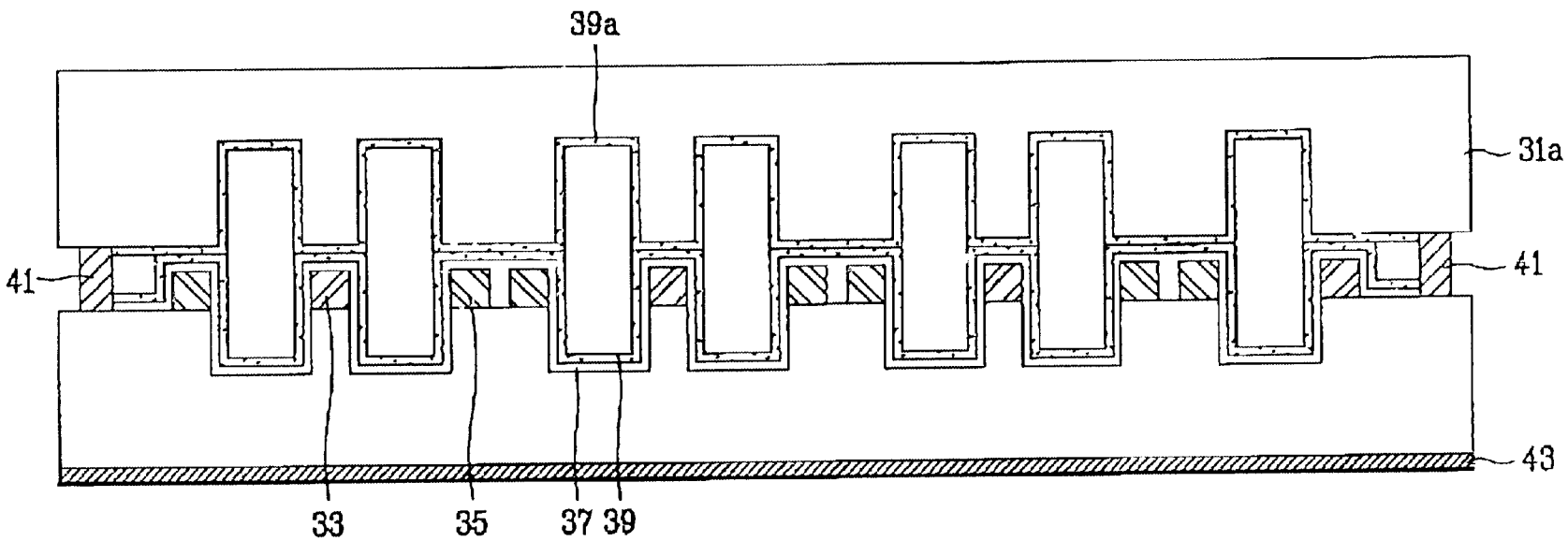
FIG. 4 is a sectional view taken along line II–II' of FIG. 3.

FIG. 3 is a plan view illustrating a flat luminescent lamp according to the present invention, and FIG. 4 is a sectional view taken along line II–I' of FIG. 3.

As shown in FIG. 3, a flat luminescent lamp according to the present invention includes a first substrate 31 and a second substrate (not shown), a plurality of first electrodes 33 formed in one direction on the first substrate 31 at constant intervals, and a plurality of second electrodes insets of pairs 35 respectively formed at both sides of the first electrodes 33. Preferably, the electrodes are formed to have a pattern that is conducive to discharging electrons. For example, the first electrodes 33 have a zig-zag structure in which the bent portions have a pointed shape.

The flat luminescent lamp according to the present invention, as shown in FIG. 4, includes first and second substrates 31 and 31*a* having a plurality of concave and convex portions. The first and second substrates 31 and 31*a* can be made of a polymer material, instead of glass material, to reduce the overall weight of the lamp. The first electrodes 33 first and second electrodes in sets of pairs are 35 alternately formed on the convex portions of the first substrate 31. A dielectric layer 37 is formed on the first substrate 31 and on the first and second electrodes 33 and 35. First phosphor layer 39 and second phosphor layers 39*a* are respectively formed on the dielectric layer 37 and on the second substrate 31*a*. The first substrate 31 and the second substrate 31*a* are attached to each other by polymer adhesion technology. As shown in FIG. 4, a polymer binder 41 attaches the first substrate 31 to the second substrate 31*a* with the concave and convex portions of one substrate in correspondence to the concave and convex portions of the other substrate.

The first and second electrodes 33 and 35*a* include a metal with low resistivity, for example, Ag, Cr, Pt, or Cu.

After an external power source is respectively connected to first and second electrodes 33 and 35, a voltage is applied to each electrode. Then, a phosphor gas such as Xe gas forms plasma between the first and second electrodes 33 and 35 thereby generating UV. The UV collides with the first and second phosphor layers 39 and 39*a* to generate white light, so that white light is emitted through the rear surface of the second substrate 31*a*. When the aforementioned flat luminescent lamp is used as a back light of an LCD device, LCD panel is positioned on the rear side of the second substrate 31*a*.

A radiation plate 43 may further be formed on the rear side of the first substrate 31, opposite to the side having convex and concave portions to externally emit heat generated during discharge. A diffusion sheet (not shown) may further be formed on the rear side of the second substrate 31*a* to uniformly distribute the white light from the flat luminescent lamp.

FIGS. 5A to 5D are sectional views illustrating process steps of manufacturing a flat luminescent lamp according to the first embodiment of the present invention.

Figure 5A:
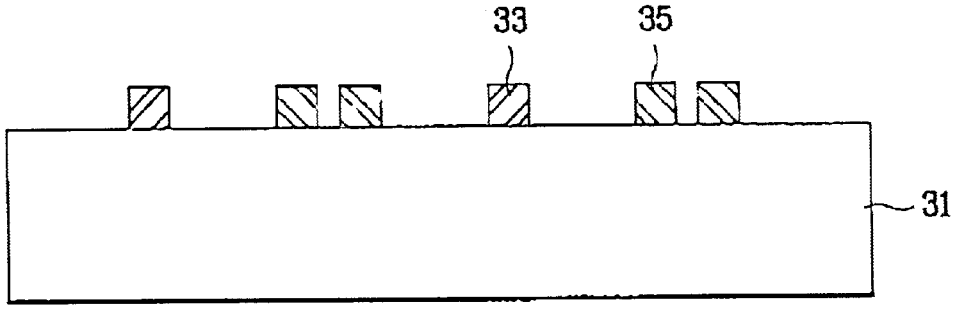
FIGS. 5A to 5D are sectional views illustrating process steps for manufacturing a flat luminescent lamp according to the first embodiment of the present invention.

As shown in FIG. 5A, a metal layer having low resistivity, such as Ag, Cr, Pt, or Cu, is patterned on the first substrate 31 of polymer material by screen printing. At this time, the first and second electrodes 33 and 35 are patterned to alternate at constant intervals.

Figure 5B:
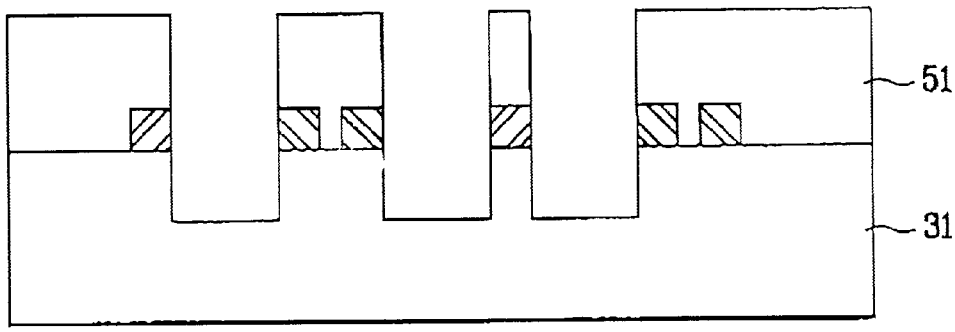

As shown in FIG. 5B, a photoresist material 51 is deposited on an entire surface of the first substrate 31, and on the first and second electrodes 33 and 35. The photoresist material 51 is then patterned by exposure and developing processes to mask the first and second electrodes 33 and 35.

The first substrate 31 is selectively etched using the patterned photoresist material 51 as a mask to form a plurality of concave portions. Subsequently, the first electrodes and second electrodes 35 are positioned on the convex portions of the substrate 31 and between concave portions of the substrate 31.

At this time, the first electrodes 33 have the same straight shape as the second electrodes 35. Alternatively, the first electrodes 33 can have a zig-zag shape unlike the second electrodes 35 or vice versa. Furthermore, both the first electrodes 33 and the second electrodes 35 can have a zig-zag shape. To further facilitate discharge between the two electrodes, it is preferable that the bent portions of the zig-zag shape are pointed.

Figure 5C:
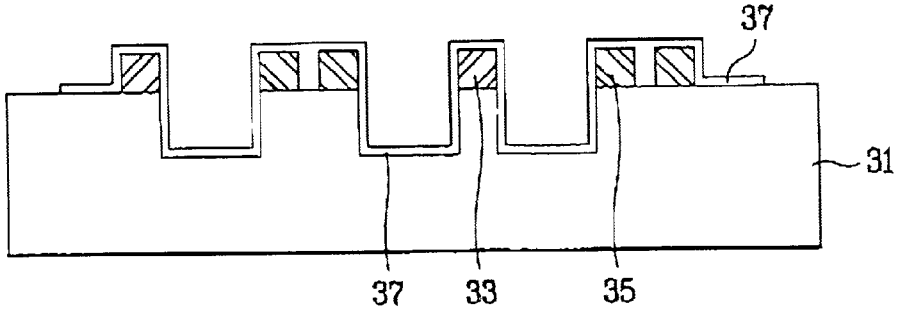

Subsequently, as shown in FIG. 5C, after the photoresist material 51 is removed, a dielectric layer 37 is formed on the entire surface of the first substrate 31, the first electrodes 33 and on the second electrodes 35.

Although not shown in the figures, a photoresist material is deposited on the second substrate 31*a* and patterned. The second substrate 31*a* is etched to a predetermined depth using the patterned photoresist material (not shown) as a mask to form a plurality of concave and convex portions. The photoresist material is patterned so that the concave and convex portions of the second substrate 31*a* will correspond to the concave and convex portions of the first substrate 31.

Figure 5D:
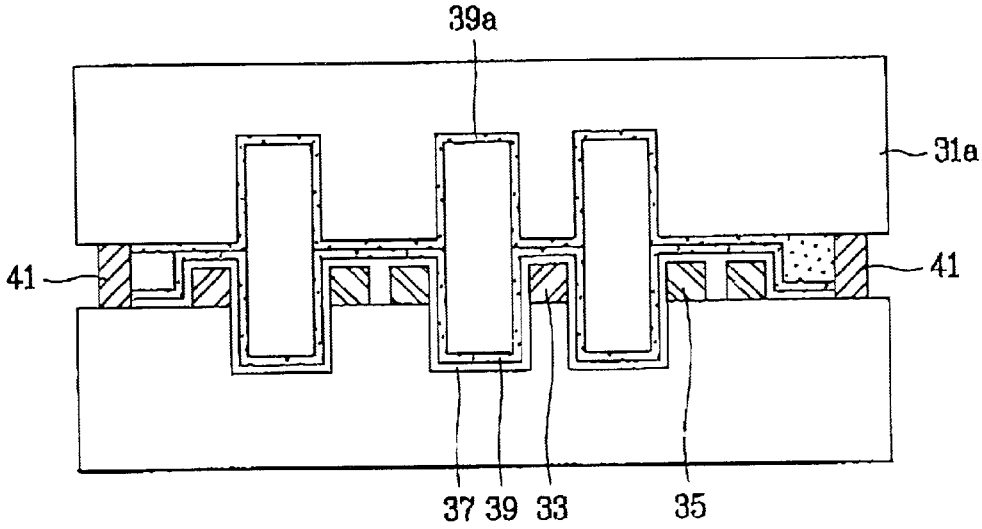

As shown in FIG. 5D, after the second substrate 31*a* of polymer material having a plurality of concave and convex portions is prepared, the first and second phosphor layers 39 and 39*a* are formed over the entire surface of the first substrate 31 and second substrates 31*a*. The first substrate 31 and second substrate 31*a* are attached to each other by polymer adhesion technology 41. The concave and convex portions of the second substrate 31*a* respectively correspond to the concave and convex portions of the first substrate 31.

Subsequently, although not shown, a phosphor gas such as Xe gas, is injected between the substrates through a gas injection hole, and then the hole is sealed. Thus, the process for manufacturing the flat luminescent lamp according to the first embodiment of the present invention is completed.

FIGS. 6A to 6D are sectional views illustrating process steps of manufacturing a flat luminescent lamp according to the second embodiment of the present invention.

In the first embodiment of the present invention, after the first and second electrodes are formed by a screen printing process, the first substrate is etched using the first and second electrodes as masks to form the plurality of concave portions. However, in the second embodiment of the present invention, before forming first and second electrodes, first and second substrates having a plurality of concave and convex portions are formed. Then, first and second electrodes are alternately formed on only the convex portions of the first substrate.

Figure 6A:
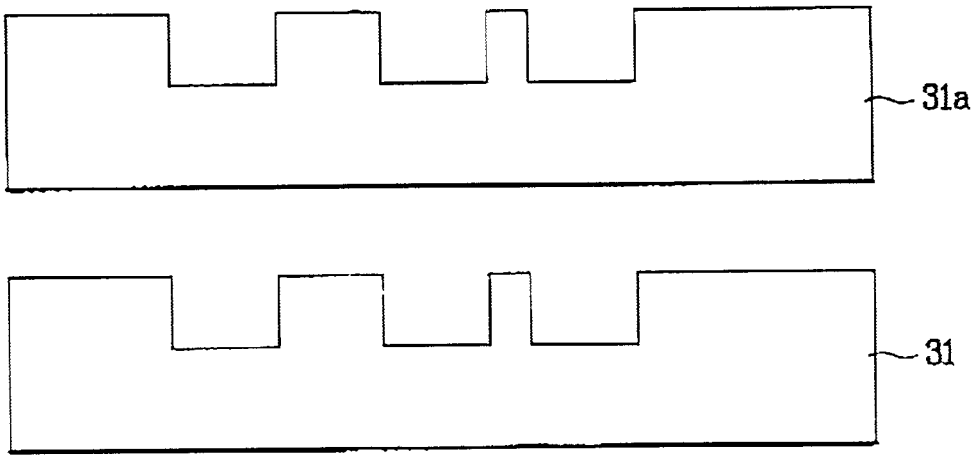
FIGS. 6A to 6D are sectional views illustrating process steps for manufacturing a flat luminescent lamp according to the second embodiment of the present invention.

In more detail, as shown in FIG. 6A, after first and second substrates 31 and 31*a* of polymer material are prepared, a plurality of concave portions are formed in one side of each of the first and second substrates 31 and 31*a*. Thus, the first and second substrates 31 and 31*a* have concave and convex portions as a whole.

The concave portions formed in the first substrate 31 are positioned to correspond to the concave portions formed in the second substrate 31*a*. Thus, a discharge space is defined by the concave portions formed in each substrate when the first substrate 31 is attached to the second substrate 31*a*.

Figure 6B:
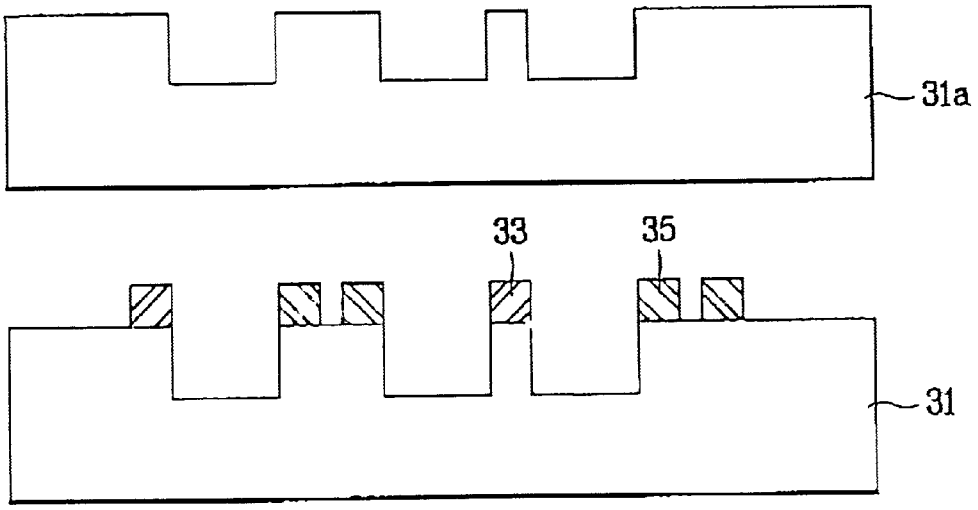

As shown in FIG. 6B, a metal layer having low specific resistivity, such as Ag, Cr, Pt, and Cu, is deposited on the first substrate 31 using a sputtering process. First and second electrodes 33 and 35 are alternately formed on the convex portions of the first substrate 31 by patterning process using photolithography.

Figure 6C:
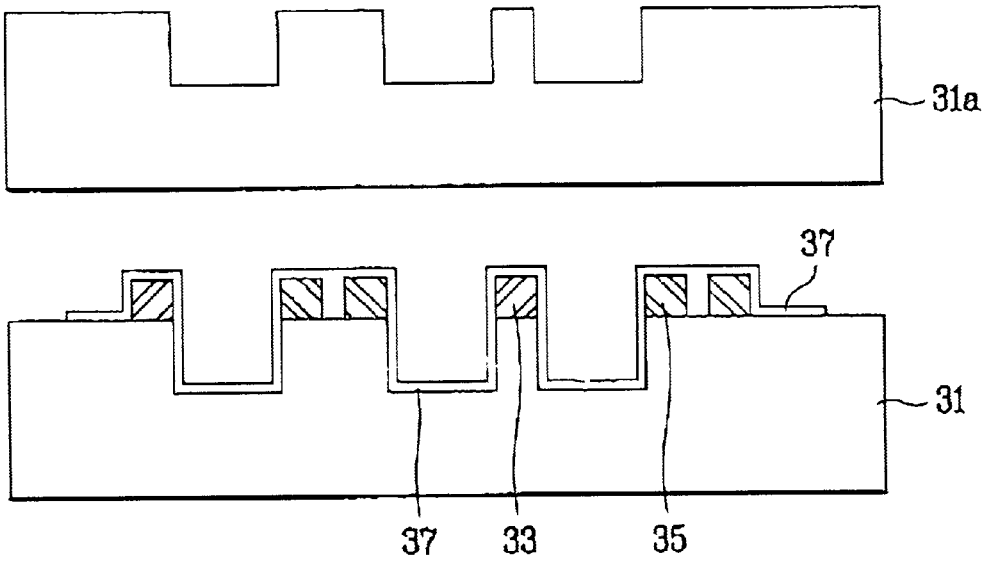
Figure 6D:
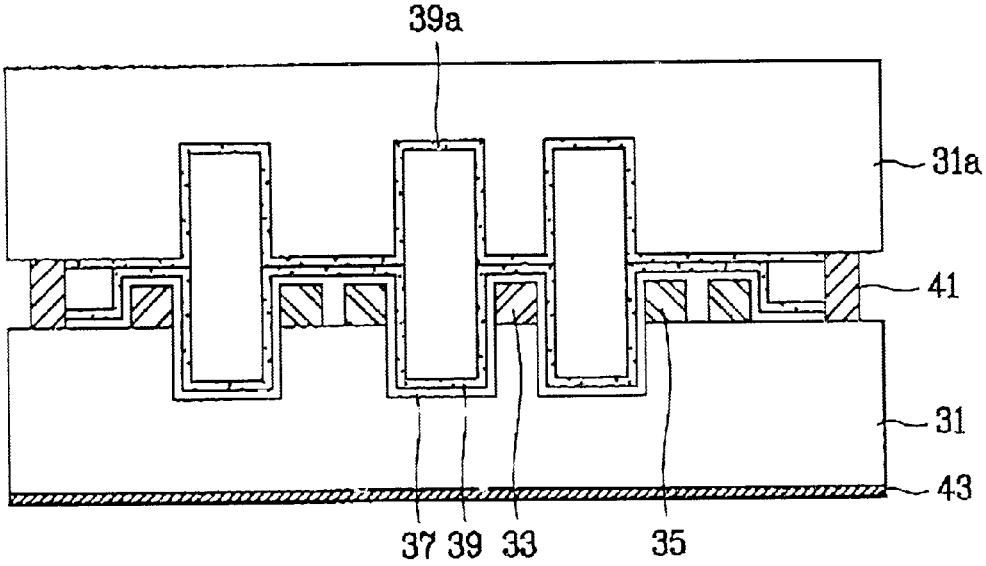

Afterwards, as shown in FIG. 6C, a dielectric layer 37 is formed on an entire surface of the first substrate 31 and on the first electrodes 33 and second electrodes 35. Subsequently, as shown in FIG. 6D, a first phosphor layer 39 is formed on the dielectric layer 37 while a second phosphor layer 39*a* is formed on the second substrate 31*a*. The first substrate 31 and the second substrate 31*a* are attached to each other to oppose each other. At this time, since the first and second substrates 31 and 31*a* are formed of polymer, they are attached to each other by generally known polymer adhesion technology 41.

A radiation plate 43 may further be formed on the rear side of the first substrate 31 opposite to the concave and convex positions so as to externally emit heat generated during discharge.

Afterwards, although not shown, a phosphor gas such as Xe gas, is injected between the substrates through a gas injection hole, and then the hole is sealed to seal the substrates. Thus, the process for manufacturing the flat luminescent lamp according to the second embodiment of the present invention is completed.

The flat luminescent lamp and the method for manufacturing the same according to the present invention have at least the following advantages.

Since the substrates can be formed of polymer material not glass material, it is possible to remarkably reduce weight of the product. Furthermore, since the electrodes are patterned to facilitate emission of electrons, discharge efficiency can be enhanced. Improvement of discharge efficiency minimizes the number of diffusion sheets formed on the rear side of the second substrate, thereby reducing the weight of the product, its thickness and manufacturing cost.

It will be apparent to those skilled in the art that various modifications and variations can be made in the flat luminescent lamp and method for manufacturing the same of the present invention without departing from the spirit or scope of the invention. Thus, it is intended that the present invention cover the modifications and variations of this invention provided they come within the scope of the appended clams and their equivalents.

What is claimed is:

1. A flat luminescent lamp comprising:

first and second substrates, each having a plurality of concave and convex portions on a surface;

first and second electrodes alternately formed on the convex portions of the first substrate at constant intervals;

a dielectric layer formed on the first substrate, and on the first and second electrodes;

first and second phosphor layers respectively formed on the dielectric layer and the second substrate; and wherein the first and second substrates are attached to each other with their surfaces having the plurality of concave and convex portions facing each other.

2. The flat luminescent lamp of claim 1, wherein the first and second substrates are comprised of a polymer material.

3. The flat luminescent lamp of claim 1, wherein one of the first and second electrodes has a zig-zag shape.

4. The flat luminescent lamp of claim 1, further comprising a radiation plate on a surface of the first substrate opposite to the surface having concave and convex portions.

5. The flat luminescent lamp of claim 4, wherein the radiation plate is comprised of metal material.

6. The flat luminescent lamp of claim 1, further comprising a diffusion sheet on a surface of the second substrate opposite to the surface having concave and convex portions.

* * * * *